US012084237B1

(12) United States Patent
Greene

(10) Patent No.: US 12,084,237 B1
(45) Date of Patent: Sep. 10, 2024

(54) BRACKET FOR SECURING A DEVICE TO A CONTAINER

(71) Applicant: Stanley Ewing Greene, Dallas, TX (US)

(72) Inventor: Stanley Ewing Greene, Dallas, TX (US)

( * ) Notice: Subject to any disclaimer, the term of this patent is extended or adjusted under 35 U.S.C. 154(b) by 0 days.

(21) Appl. No.: 18/209,432

(22) Filed: Jun. 13, 2023

Related U.S. Application Data

(60) Continuation-in-part of application No. 17/392,044, filed on Aug. 2, 2021, now Pat. No. 11,702,240, which is a division of application No. 16/524,148, filed on Jul. 28, 2019, now Pat. No. 11,104,475, which is a continuation-in-part of application No. 16/386,220, filed on Apr. 16, 2019, now Pat. No. 11,076,665, which is a continuation-in-part of application No. 13/840,903, filed on Mar. 15, 2013, now Pat. No. 10,308,391.

(51) Int. Cl.
*B65D 5/42* (2006.01)
*A47B 97/04* (2006.01)

(52) U.S. Cl.
CPC ..... *B65D 5/42* (2013.01); *A47B 97/04* (2013.01)

(58) Field of Classification Search
CPC ..... B65D 5/42; B42F 1/02
USPC ..... 24/545; 206/45.24
See application file for complete search history.

(56) References Cited

U.S. PATENT DOCUMENTS 1,369,717 A * 2/1921 Stark ..... B42F 3/00 24/711.5
3,123,924 A * 3/1964 Roberts ..... B42F 21/00 D19/86
3,225,469 A * 12/1965 Chase ..... B42F 21/00 D19/86
3,913,181 A * 10/1975 Walker ..... B42F 1/08 24/67.9
4,480,356 A * 11/1984 Martin ..... B42F 1/02 40/660
4,665,594 A * 5/1987 Wagner ..... A44B 15/00 24/546
4,675,953 A * 6/1987 Higgs ..... A44C 1/00 24/67.3
5,406,680 A * 4/1995 Silverberg ..... B42F 1/08 24/546
5,481,784 A * 1/1996 Sinaiko ..... B42F 1/08 24/67.11
5,655,266 A * 8/1997 Gish ..... B42F 1/08 24/DIG. 10
5,887,900 A * 3/1999 Raymond ..... B42F 11/00 283/67
7,434,343 B2 * 10/2008 Yoshida ..... B42F 21/06 40/641
D686,490 S * 7/2013 Lozano ..... D8/402
11,198,317 B2 * 12/2021 Collath ..... B42F 1/08
2002/0104199 A1 * 8/2002 Chen ..... B42F 1/08 24/67.9
2004/0064920 A1 * 4/2004 Arduini ..... B42F 1/08 24/67.9
2006/0107496 A1 * 5/2006 Cheng ..... B42F 1/08 24/67.9

(Continued)

*Primary Examiner* — Ernesto A Grano
(74) *Attorney, Agent, or Firm* — Papalas PLLC

(57) ABSTRACT

Embodiments describe a bracket for securing a device or other object to a container using one or more straps.

10 Claims, 9 Drawing Sheets

(56) References Cited

U.S. PATENT DOCUMENTS

| | | | | |
|---|---|---|---|---|
| 2007/0067966 | A1* | 3/2007 | Flores | B42F 1/08 24/67.3 |
| 2011/0258813 | A1* | 10/2011 | Lu | B42F 1/08 24/67.9 |
| 2012/0047698 | A1* | 3/2012 | O'Daniel | B42F 1/08 24/67 R |
| 2013/0205565 | A1* | 8/2013 | Santos | B42F 1/08 362/382 |
| 2014/0090210 | A1* | 4/2014 | Tillinghast | B42F 1/08 24/67.9 |
| 2014/0137391 | A1* | 5/2014 | Beach | B42F 1/08 29/525.08 |
| 2014/0201952 | A1* | 7/2014 | Windorski | G09F 3/12 156/227 |
| 2015/0007420 | A1* | 1/2015 | Lusher | B42F 1/08 24/67.9 |
| 2016/0129721 | A1* | 5/2016 | Balma | B42F 1/08 24/67.9 |

* cited by examiner

BRACKET FOR SECURING A DEVICE TO A CONTAINER

RELATED APPLICATIONS

This application is a continuation-in-part of the U.S. patent application Ser. No. 17/392,044, filed on 2 Aug. 2021, entitled A POCKET HOLDER AND AN EASEL, the disclosure of which is hereby incorporated herein by reference in its entirety; which is a divisional application of U.S. patent application Ser. No. 16/524,148, filed on 28 Jul. 2019, entitled A POCKET HOLDER AND AN EASEL, the disclosure of which is hereby incorporated herein by reference in its entirety; which is a continuation-in-part application of U.S. patent application Ser. No. 16/386,220, filed on 16 Apr. 2019, entitled A CONTAINER AND STAND FOR A PORTABLE DEVICE, the disclosure of which is hereby incorporated herein by reference in its entirety; which is a continuation-in-part application of U.S. patent application Ser. No. 13/840,903, filed on 15 Mar. 2013, entitled A CONTAINER AND STAND FOR A PORTABLE DEVICE, the disclosure of which is hereby incorporated herein by reference in its entirety.

TECHNICAL FIELD

A bracket for holding a device or other item to a container to allow transport of the device or other item, use of the device or other item, or display of the device or other item.

BACKGROUND

Recycling is a process using waste materials to form new products. Recycling prevents waste of new materials, and reduces the consumption of fresh raw materials, as recycling uses discarded or otherwise used materials to form the new products. Recycling may also reduce energy and water usage in the formation of materials from raw ingredients. Recycling also reduces pollution by preventing the disposal of the materials. For example, recycling reduces air pollution from incineration, and land and water pollution from land filling. Recycling is a key component of modern waste reduction and is the third component of the "Reduce, Reuse, Recycle" waste hierarchy.

FIG. 7 depicts a prior art example of a paper clip. FIG. 7 depicts a typical paperclip 700. The more popular sizes for prior art paper clip 700 are on the order of 1.25 inches to 2 inches in overall length. Inner loop connecting leg 701 and outer loop connecting leg 702 are extended in length in relation to the free leg of their respective loops to permit joinder by curved interconnector 703. Distal ends 704, 705 of respective inner and outer loop-free legs are located along the main body of clip 700, typically about one-fourth the distance longitudinally from the curved interconnector 703 end of the clip; e.g. with a clip having a two-inch overall length, such distal ends are located about one half inch from the midpoint of curved interconnector 703. See FIG. 1 of U.S. Pat. No. 5,329,672 to Froehlich et al., issued 19 Jul. 1994.

SUMMARY

Embodiments of the invention are directed to a bracket for holding a device or other item in a container. One embodiment is a bracket that secures a device to a container using a strap, wherein the strap is connected to the container, the bracket comprises: a strap holding portion that connects the strap to the bracket; a securing portion that connects the device to the bracket; a first retention portion that is proximate to the strap holding portion and positioned to allow the strap to slide into the strap holding portion; and a second retention portion that is proximate to the first retention portion and the strap holding portion, wherein the second retention portion is positioned to allow the strap to slide into the strap holding portion and allow the strap to be removed from the strap holding portion; wherein the bracket is a formed from a metal wire; and wherein the strap holding portion is coated with a material to prevent damage to the device.

BRIEF DESCRIPTION OF THE DRAWINGS

Figure 1A:
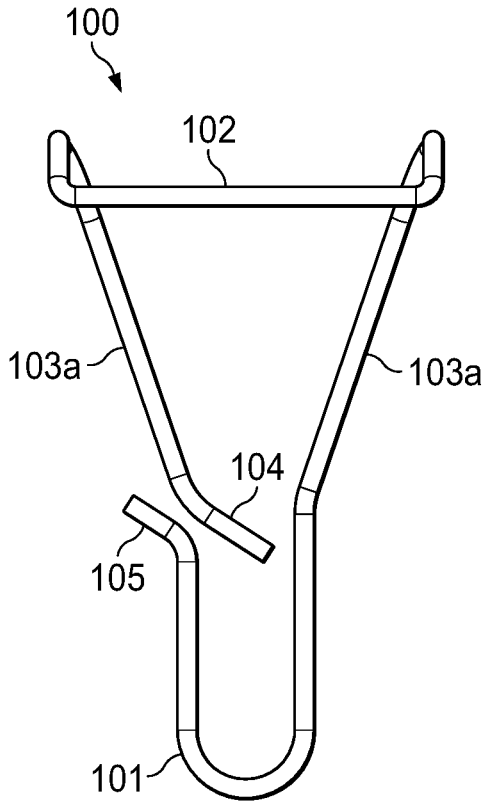
Figure 1B:
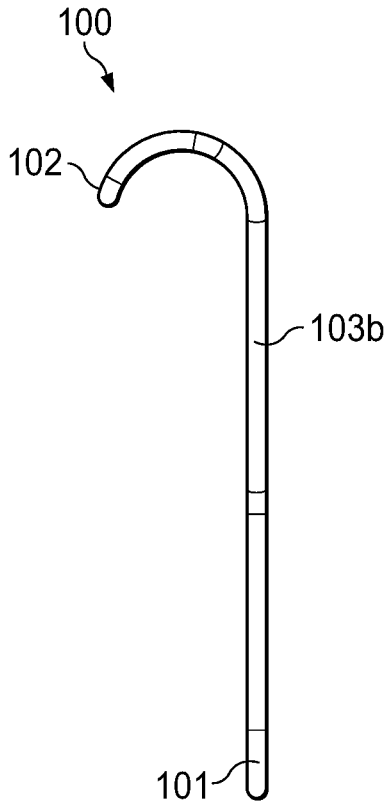
Figure 1C:
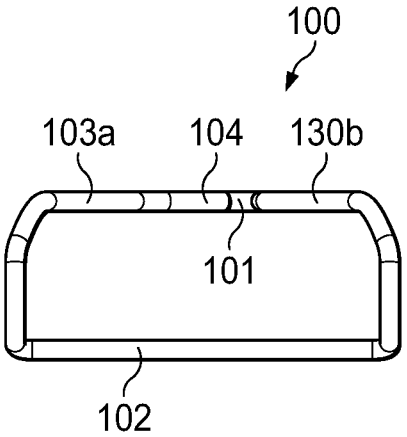
Figure 2A:
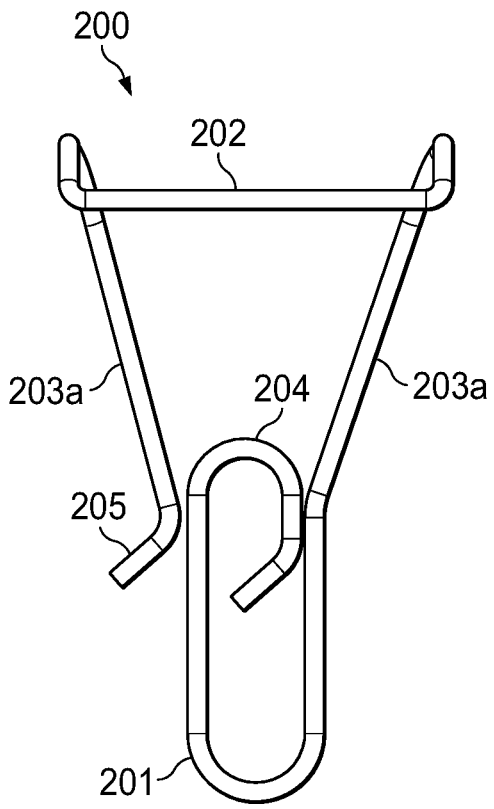
Figure 2B:
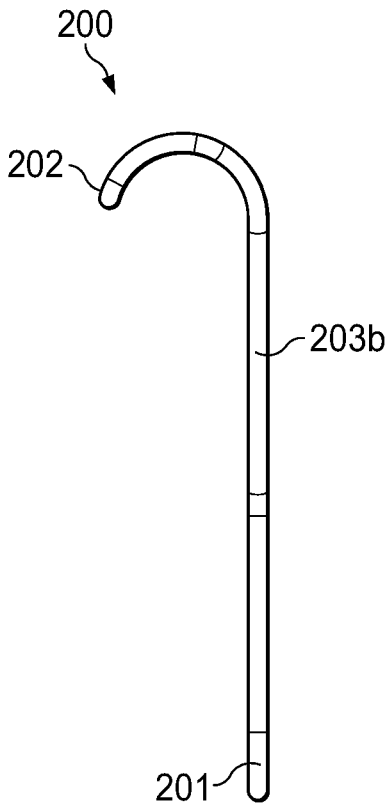
Figure 2C:
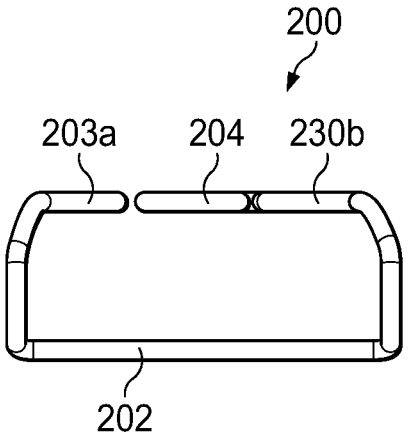
Figure 3A:
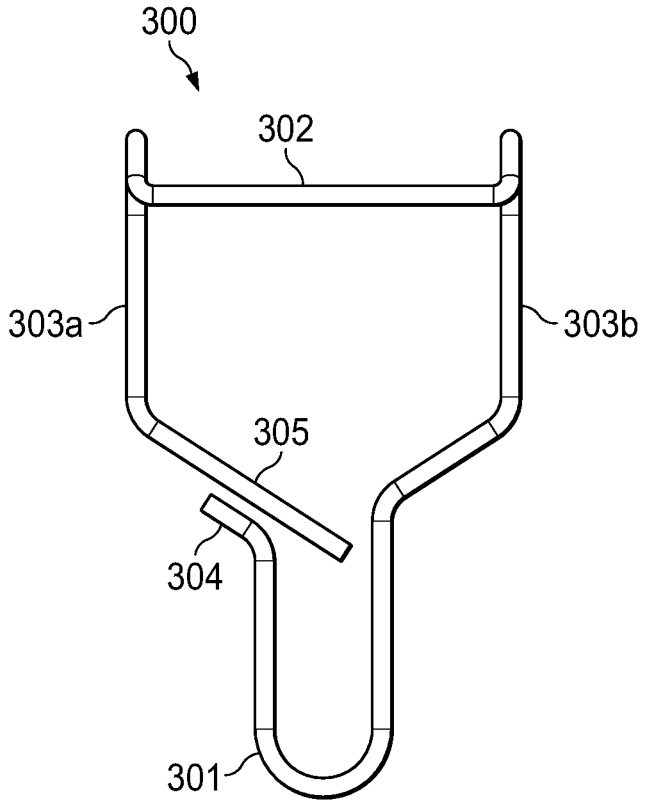
Figure 3B:
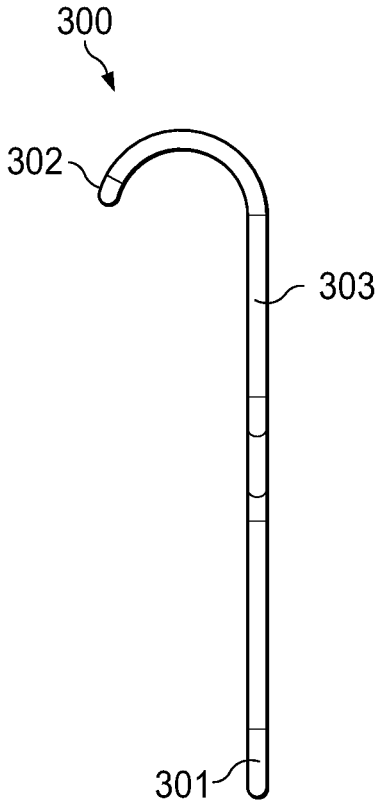
Figure 3C:
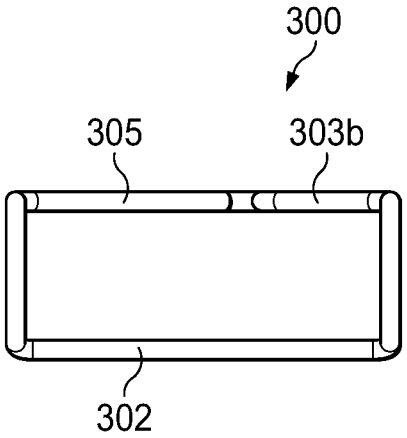
Figure 4A:
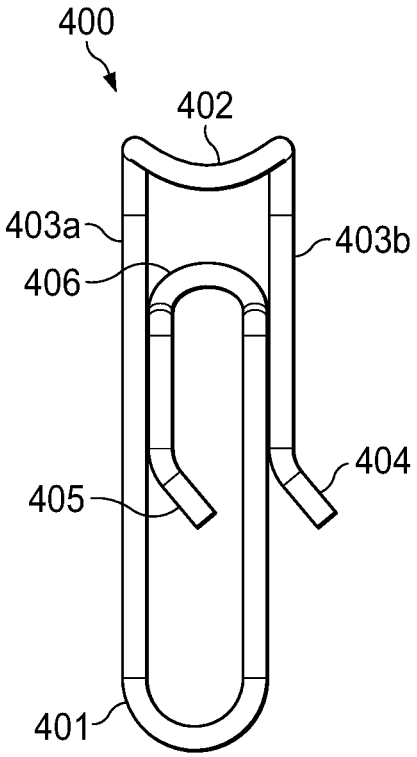
Figure 4B:
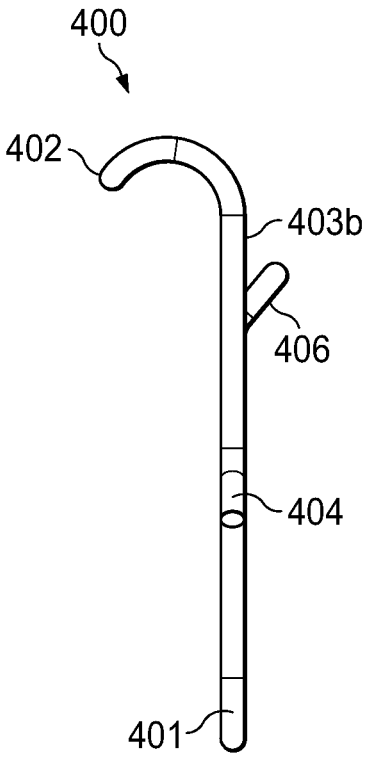
Figure 4C:
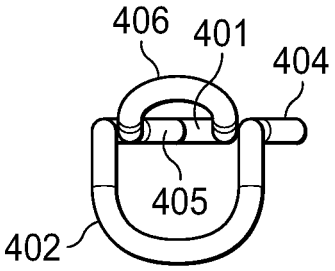
Figure 5:
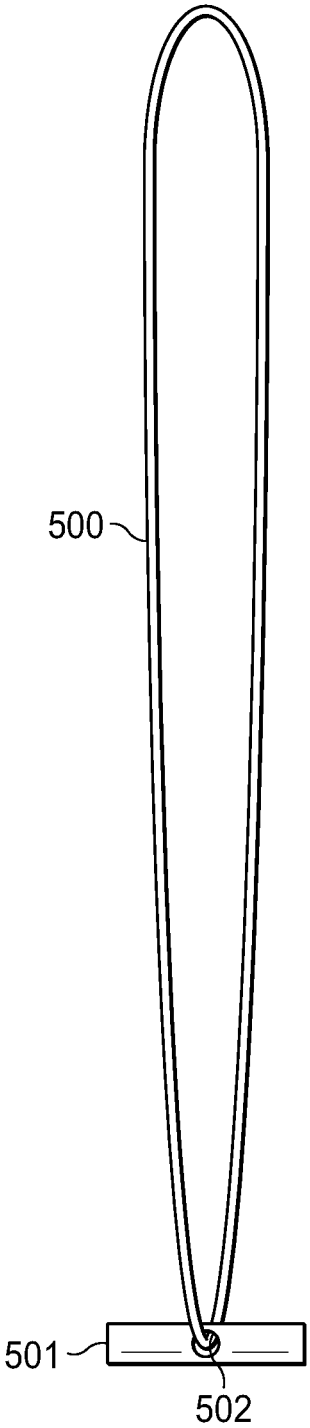
Figure 6A:
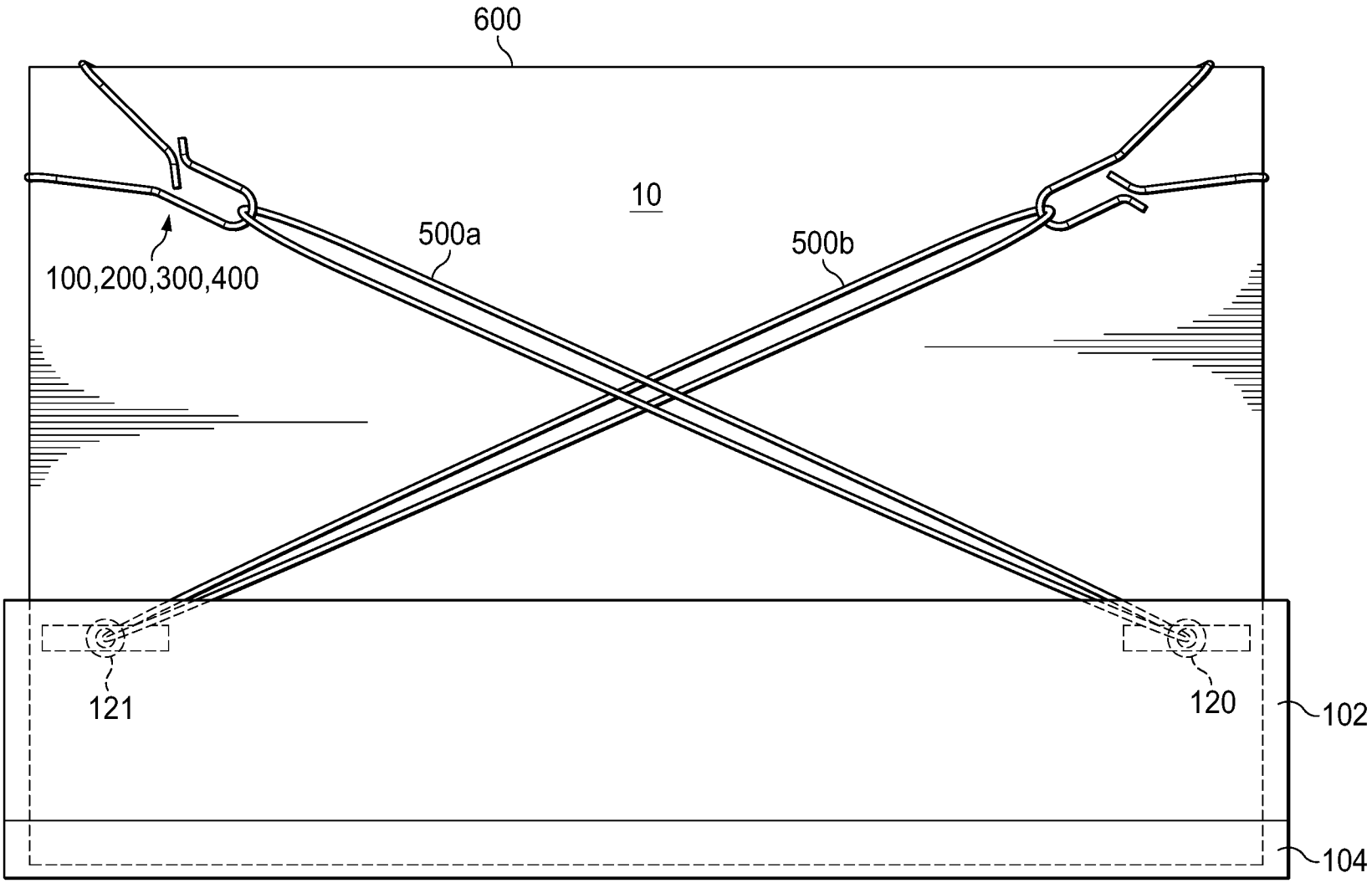
Figure 6B:
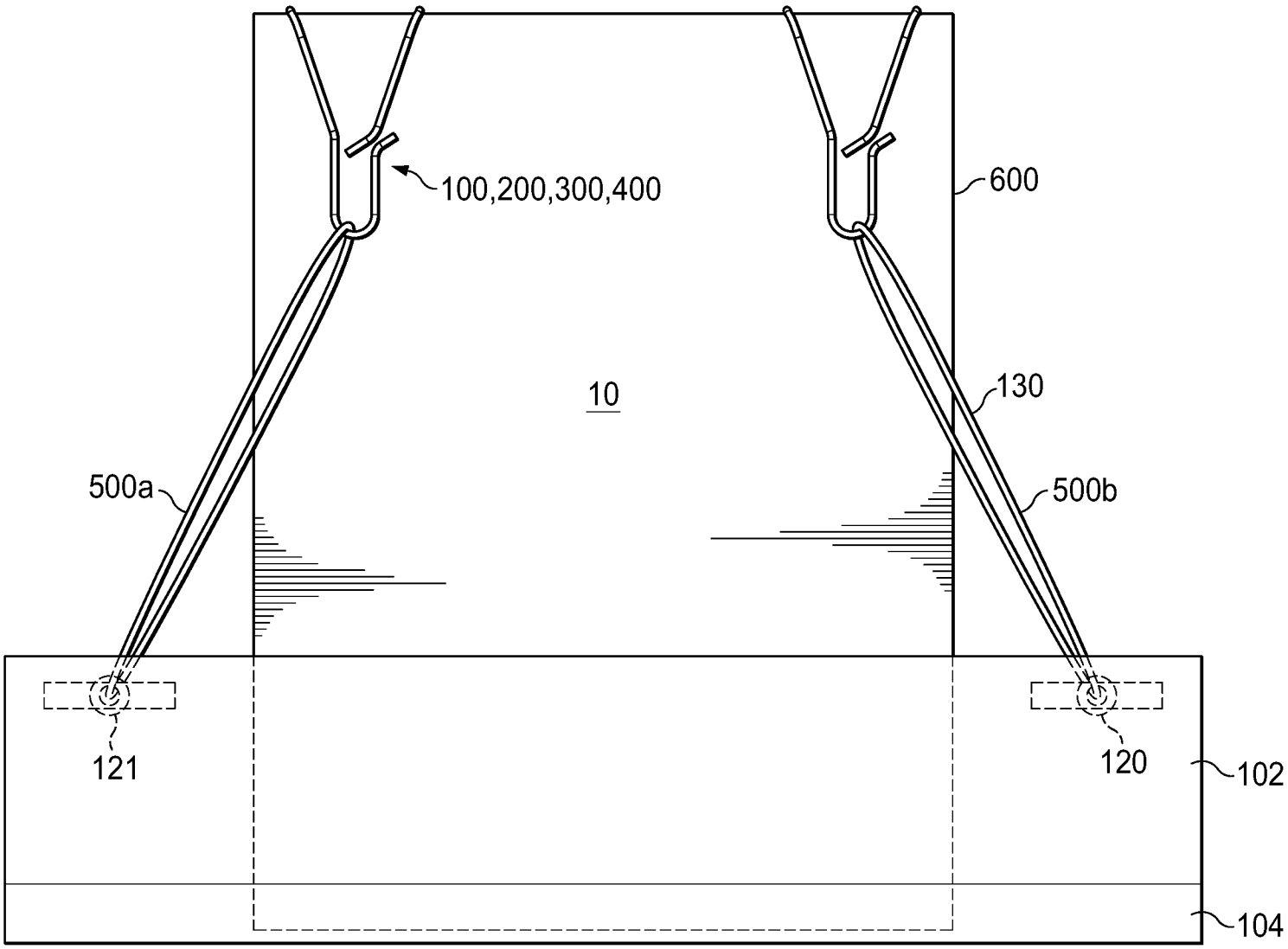
Figure 6C:
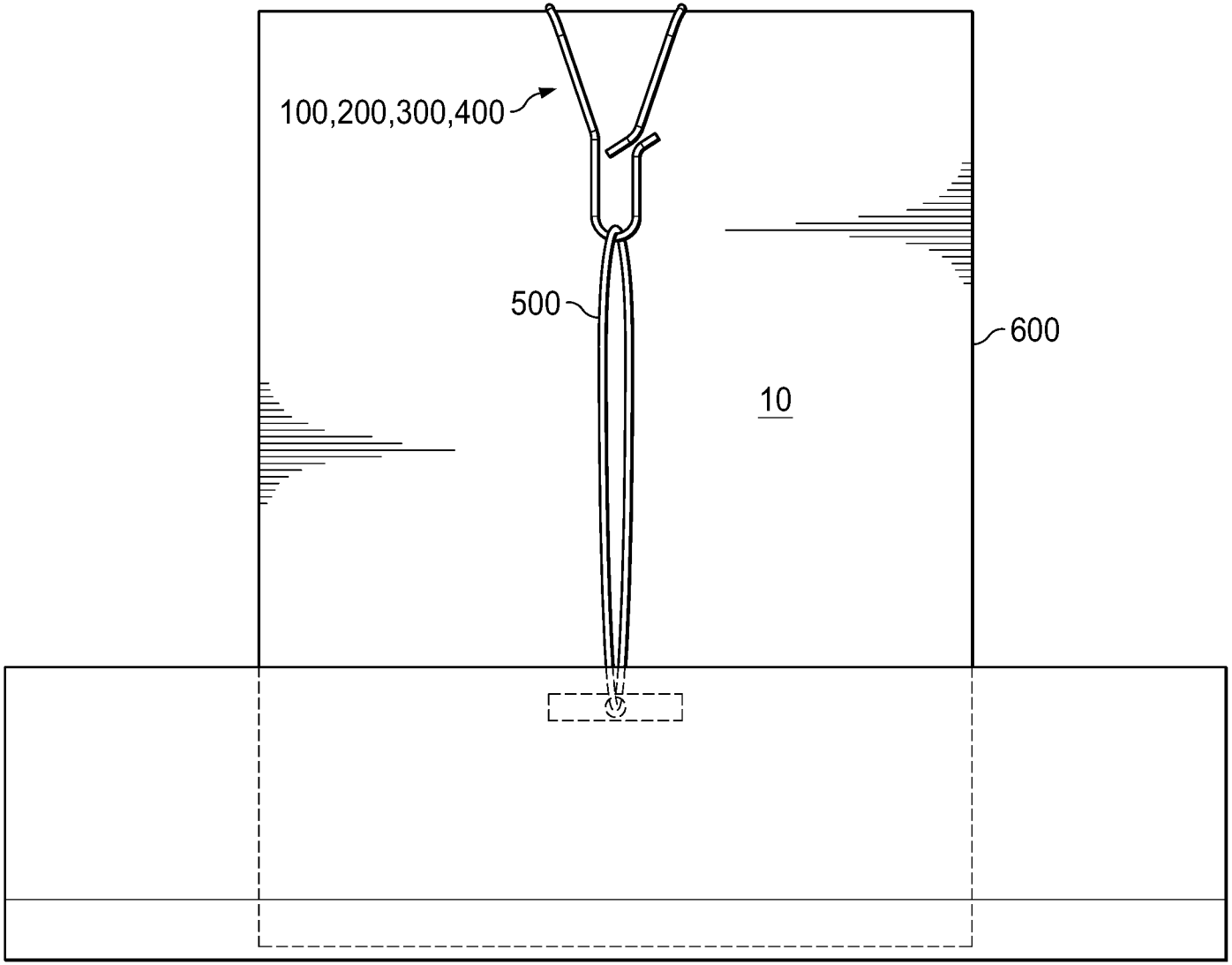
Figure 7:
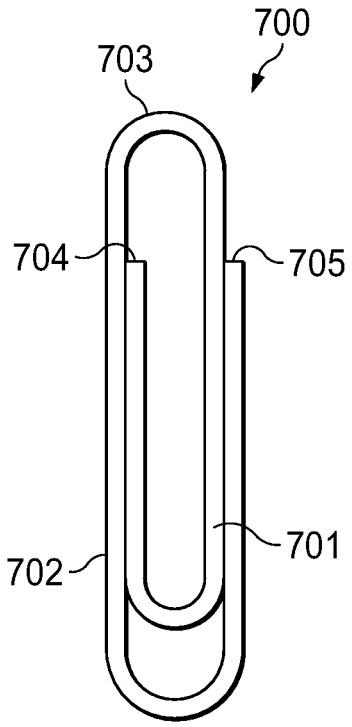
FIG. 7 (PRIOR ART)

Having thus described the invention in general terms, reference will now be made to the accompanying drawings, which are not necessarily drawn to scale, and wherein:

FIGS. 1A-1C depict a first embodiment of the bracket;

FIGS. 2A-2C depict a second embodiment of the bracket;

FIGS. 3A-3C depict a third embodiment of the bracket;

FIGS. 4A-4C depict a forth embodiment of the bracket;

FIG. 5 depicts an example of a strap that is to be used in conjunction with the embodiments of the bracket;

FIGS. 6A-6C depict different arrangements of one or more brackets being used to secure a device or other object to a container; and FIG. 7 depicts a prior art example of a paper clip.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

The various brackets shown herein are intended to improve the retaining straps shown in the various priority applications. For example, the straps 130 of FIG. 2 of U.S. patent application Ser. No. 13/840,903, filed on 15 Mar. 2013, entitled A CONTAINER AND STAND FOR A PORTABLE DEVICE, the disclosure of which is hereby incorporated herein by reference in its entirety. As well as, the straps 130a, 130b of FIG. 6 of U.S. patent application Ser. No. 16/386,220, filed on 16 Apr. 2019, entitled A CONTAINER AND STAND FOR A PORTABLE DEVICE, the disclosure of which is hereby incorporated herein by reference in its entirety. And further the brackets shown herein may be used with either the pocket holder or easel of U.S. patent application Ser. No. 16/524,148, filed on 28 Jul. 2019, entitled A POCKET HOLDER AND AN EASEL. The pocket holder or easel may include straps that use the brackets shown herein.

The brackets described herein may be repurposed from an existing item. The preferred item is a metal wire paper clip. The metal used in most paper clips is ductile enough to allow for the paper clip to be reformed into the bracket, and yet plastic enough to allow the now-formed bracket to retain its shape. Alternatively, the brackets may be formed from metal wire from a spool.

The brackets are an improvement over the straps of the Applications of U.S. patent application Ser. No. 13/840,903, filed on 15 Mar. 2013, entitled A CONTAINER AND STAND FOR A PORTABLE DEVICE, and U.S. patent application Ser. No. 16/386,220, filed on 16 Apr. 2019, entitled A CONTAINER AND STAND FOR A PORTABLE DEVICE. The straps are used in conjunction with the container described in U.S. patent application Ser. No. 13,840,903, filed on 15 Mar. 2013, entitled A CONTAINER AND STAND FOR A PORTABLE DEVICE, and U.S. patent application Ser. No. 16/386,220, filed on 16 Apr. 2019, entitled A CONTAINER AND STAND FOR A PORTABLE DEVICE. The container has two main functions expressed as modes. The first mode is to hold or contain the device or other object. The first mode is known as the transport mode or case mode. The container protects the device by covering the screen of the device and padding the device during transport of the device. The second mode of the container is to act as a stand for the device. The container supports the device in a position that allows the device to be used by a user. The second mode is the stand mode or display mode. The straps secure the device to the container.

The device may be an electronic device, a portable electronic device, a computer device, a display screen, an image projector, an IPAD, a notebook computer, an MP3 player, a personal data assistant, a cellular telephone, a camera, and a smart phone. The device may also be a non-electronic device, such as marker board, chalk board, a paper tablet, and the container would function as a binder. As such, the devices may be expensive and fragile.

The straps defined in U.S. patent application Ser. No. 13/840,903, filed on 15 Mar. 2013, entitled A CONTAINER AND STAND FOR A PORTABLE DEVICE, and U.S. patent application Ser. No. 16/386,220, filed on 16 Apr. 2019, entitled A CONTAINER AND STAND FOR A PORTABLE DEVICE, can easily slip off of the device or other item being secured in the container and stand. For example, the straps may slip off during switching the container between the transport mode and the display mode. Also, the devices may have glass edges that cut or otherwise abrade the strap such that the strap may break prematurely and unexpectedly.

Note that it is preferable that the brackets have a coating of a soft material such as plastic or rubber. Many paperclips are already coated with such material. The coating prevents the bracket from damaging the device, especially a glass screen. If the paperclip is uncoated, the bracket formed there from may be coated with a material after the bracket is formed. Note only the part the bracket that contacts the device needs to be coated or covered. The coating or covering material may comprise rubber, plastic, nail polish, tape, plastic adhesive, glue, and any other material that would prevent or lessen damage to the device.

FIGS. 1A-1C depict a first embodiment of the bracket. FIG. 1A depicts a front elevation view of the bracket 100. FIG. 1B depicts a side elevation view of the bracket 100, namely the right side view of FIG. 1A. FIG. 1C depicts a top down view of the bracket 100.

The bracket 100 comprises strap holding portion 101. The strap would pass through strap retention portions 104, 105 to settle into holding portion 101. The retention portion 105 is pointed outward from the bracket 100 to allow the strap 500 of FIG. 5 to more readily slip into the bracket. The retention portion 104 is pointed inward into the center of the bracket 100 to allow the strap 500 of FIG. 5 to more readily slip into the bracket. The retention portion 104 also allows the strap to be removed from the bracket. The portion 104 serves as a guide to allow the strap to be pulled from the bracket. The device securing portion 102 interacts with the device or other item being stored or displayed by the container 600 of FIG. 6A-6C. The bracket support portions 103*a*, 103*b* connect the securing portion 102 with the holding portion 101 to secure the device or other item to the container 600.

It is preferable to have the retention portions 104, 105 to be mostly co-planar with the holding portion 101 and the bracket support portions 103*a*, 103*b*. This would prevent the retention portions 104, 105 from digging into the device or any of portions 101, 103*a*, 103*b*, 104 or 105 from snagging an item external from the container.

Note that portions 101, 103*a*, 103*b*, 104, 105 are adjacent to the rear portion of the device, while the portion 102 wraps around the upper part of the device, with a front portion of 102 contacting the upper front part of the device. This would allow the device to be secured by the bracket, while allowing view or use of the device without being significantly obscured by the bracket.

The embodiment of FIGS. 1A-1C has the advantage of allowing the strap to be easily attached or detached from the bracket.

FIGS. 2A-2C depict a second embodiment of the bracket. FIG. 2A depicts a front elevation view of the bracket 200. FIG. 2B depicts a side elevation view of the bracket 200, namely the right side view of FIG. 2A. FIG. 2C depicts a top down view of the bracket 200.

The bracket 200 comprises strap holding portion 201. The strap would pass through strap retention portions 204, 205 to settle into holding portion 201. The retention portion 205 is pointed outward from the bracket 200 to allow the strap 500 of FIG. 5 to more readily slip into the bracket. The retention portion 204 is looped inward and downward into the holding portion 201 to allow the strap 500 of FIG. 5 to more readily slip into the bracket. The retention portion 204 is looped to prevent the strap from slipping out of the holding portion 201. The retention portion 204 also allows the strap to be removed from the bracket. The portion 204 serves as a guide to allow the strap to be pulled from the bracket. The device securing portion 202 interacts with the device or other item being stored or displayed by the container 600 of FIG. 6A-6C. The bracket support portions 203*a*, 203*b* connect the securing portion 202 with the holding portion 201 to secure the device or other item to the container 600.

It is preferable to have the retention portions 204, 205 to be mostly co-planar with the holding portion 201 and the bracket support portions 203*a*, 203*b*. This would prevent the retention portions 204, 205 from digging into the device or any of portions 201, 203*a*, 203*b*, 204 or 205 from snagging an item external from the container.

Note that portions 201, 203*a*, 203*b*, 204, 205 are adjacent to the rear portion of the device, while the portion 202 wraps around the upper part of the device, with a front portion of 202 contacting the upper front part of the device. This would allow the device to be secured by the bracket, while allowing view or use of the device without being significantly obscured by the bracket.

The embodiment of FIGS. 2A-2C has the advantage of allowing the strap to be easily attached to the bracket, while inhibiting detachment of the strap from the bracket.

FIGS. 3A-3C depict a third embodiment of the bracket. FIG. 3A depicts a front elevation view of the bracket 300. FIG. 3B depicts a side elevation view of the bracket 300, namely the right side view of FIG. 3A. FIG. 3C depicts a top down view of the bracket 300.

The bracket 300 comprises strap holding portion 301. The strap would pass through strap retention portions 304, 305 to settle into holding portion 301. The retention portion 305 is pointed inward toward the center of the bracket 300 to allow the strap 500 of FIG. 5 to more readily slip into the bracket.

The retention portion 304 is looped outward from the center of the bracket to allow the strap 500 of FIG. 5 to more readily slip into the bracket. The retention portion 305 also allows the strap to be removed from the bracket. The portion 305 serves as a guide to allow the strap to be pulled from the bracket. The device securing portion 302 interacts with the device or other item being stored or displayed by the container 600 of FIG. 6A-6C. The bracket support portions 303*a*, 303*b* connect the securing portion 302 with the holding portion 301 to secure the device or other item to the container 600.

It is preferable to have the retention portions 304, 305 to be mostly co-planar with the holding portion 301 and the bracket support portions 303*a*, 303*b*. This would prevent the retention portions 304, 305 from digging into the device or any of portions 301, 303*a*, 303*b*, 304 or 305 from snagging an item external from the container.

Note that portions 301, 303*a*, 303*b*, 304, 305 are adjacent to the rear portion of the device, while the portion 302 wraps around the upper part of the device, with a front portion of 302 contacting the upper front part of the device. This would allow the device to be secured by the bracket, while allowing view or use of the device without being significantly obscured by the bracket.

The embodiment of FIGS. 3A-3C has the advantage of having a wider securing portion 302 with respect to the securing portions of brackets 100, 200. Bracket 300 may be more useful in a configuration of FIG. 6C.

FIGS. 4A-4C depict a fourth embodiment of the bracket. FIG. 4A depicts a front elevation view of the bracket 400. FIG. 4B depicts a side elevation view of the bracket 400, namely the right side view of FIG. 4A. FIG. 4C depicts a top down view of the bracket 400.

The bracket 400 comprises strap holding portion 401. The strap would pass through strap retention portions 404, 405 to settle into holding portion 401. The retention portion 405 is pointed inward toward the center of the bracket 400 to allow the strap 500 of FIG. 5 to more readily slip into the bracket. The slip portion 406 is angled away from the bracket to allow the strap to be more easily slid into the bracket. The retention portion 404 is pointed outward from the center of the bracket to allow the strap 500 of FIG. 5 to be more readily detached from the bracket. The strap would be released by pushing part the of strap around portion 404 and into the portion 401. This would allow the strap to be pulled free from the device. The device securing portion 402 interacts with the device or other item being stored or displayed by the container 600 of FIG. 6A-6C. The bracket support portions 403*a*, 403*b* connect the securing portion 402 with the holding portion 401 to secure the device or other item to the container 600.

It is preferable to have the retention portions 404, 405 to be mostly co-planar with the holding portion 401 and the bracket support portions 403*a*, 403*b*. This would prevent the retention portions 404, 405 from digging into the device or any of portions 401, 403*a*, 403*b*, 404 or 405 from snagging an item external from the container. It is preferable to have portion 406 being non-coplanar with portions 401, 403*a*, 403*b*, 404, 405. This allows for the strap to be easily pulled into the bracket.

Note that portions 401, 403*a*, 403*b*, 404, 405 are adjacent to the rear portion of the device, while the portion 402 wraps around the upper part of the device, with a front portion of 402 contacting the upper front part of the device. This would allow the device to be secured by the bracket, while allowing view or use of the device without being significantly obscured by the bracket.

The embodiment of FIGS. 4A-4C has the advantage of allowing the strap to be easily installed and easily removed with respect to the brackets 100, 200, and 300.

FIG. 5 depicts an example of a strap that is to be used in conjunction with the embodiments of the bracket. In this example, the retraining strap 500 includes a dowel 501 to allow the strap to be connected to a container. The strap 500 may be comprised of a rubber band, an elastic band, and/or a hair band. Other attachments can be used, for example, a hole in the container may be used to pass that strap through with a slip knot. FIG. 5 is adapted from FIG. 2 of U.S. patent application Ser. No. 13/840,903, filed on 15 Mar. 2013, entitled A CONTAINER AND STAND FOR A PORTABLE DEVICE.

FIGS. 6A-6C depict different arrangements of one or more brackets being used to secure a device or other object to a container. FIGS. 6A-6C depict a rear view of the container 600 in the stand mode. FIGS. 6A-6C are adapted from FIGS. 8A and 8B U.S. patent application Ser. No. 13/840,903, filed on 15 Mar. 2013, entitled A CONTAINER AND STAND FOR A PORTABLE DEVICE.

FIG. 6A depicts the container 600 with the device 10 being arranged in a landscape position or horizontal position. The retaining straps 500*a*, 500*b* are crossed behind the device as shown. Any of brackets 100, 200, 300 and 400 may used to couple the device 10 with the straps.

FIG. 6B depicts the container 600 with the device 10 being arranged in a portrait position or vertical position. Any of brackets 100, 200, 300 and 400 may used to couple the device 10 with the straps. The retaining straps 500*a*, 500*b* are not crossed behind the device as shown, but rather each strap is looped around the same-side (as the strap) upper corner of the device.

FIG. 6C depicts the container 600 with the device 10 being arranged in a portrait position or vertical position. This arrangement uses a single strap 500 with a single bracket. Any of brackets 100, 200, 300 and 400 may used to couple the device 10 with the strap.

Note that the arrangements of FIGS. 6A-6C are by way of example only, as the arrangements could be different.

The container of U.S. patent application Ser. No. 13/840,903, filed on 15 Mar. 2013, entitled A CONTAINER AND STAND FOR A PORTABLE DEVICE, and U.S. patent application Ser. No. 16/386,220, filed on 16 Apr. 2019, entitled A CONTAINER AND STAND FOR A PORTABLE DEVICE, may use one bracket that is located in the upper middle portion of the device as shown in FIG. 6C. Alternatively, the container may use two brackets, with each bracket being located in a respective upper corner of the device. The brackets may be placed around the corners, as shown in FIG. 6A or located near the corners, but on the upper part of the device as shown in FIG. 6B.

The bracket 100, 200, 300, 400 may be formed from a paper clip. One method of making a bracket may be to bend the paper clip until it is a substantially straight piece of wire. Then the wire may be bent to form the various portions.

As used herein, the words "comprise," "have," "include," and all grammatical variations thereof are each intended to have an open, non-limiting meaning that does not exclude additional elements or steps.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A bracket that secures a device to a container using a strap, wherein the strap is connected to the container, the bracket comprises:

a strap holding portion that connects the strap to the bracket;

a securing portion that connects the device to the bracket;

a first retention portion that is proximate to the strap holding portion and positioned to allow the strap to slide into the strap holding portion; and a second retention portion that is proximate to the first retention portion and the strap holding portion, wherein the second retention portion is positioned to allow the strap to slide into the strap holding portion and allow the strap to be removed from the strap holding portion;

wherein the bracket is a formed from a metal wire;

wherein the strap holding portion is coated with a material to prevent damage to the device;

wherein the strap holding portion, the first retention portion and the second retention portion are substantially coplanar and define a plane;

wherein the securing portion comprises a first portion that curvedly extends at a non-zero angle from the plane, and a second portion that curvedly extends at a non-zero angle from the first portion, such that the first and second portions form a cavity that surrounds the device.

2. The bracket of claim 1, wherein the metal wire is a paper clip.

3. The bracket of claim 1, further comprising:

a first bracket support portion connected to the securing portion and the first retention portion; and a second bracket support portion connected to the securing portion and the second retention portion;

wherein the first bracket support portion, the second bracket support portion, and the securing portion have a triangular shape;

wherein the first bracket support portion and the second bracket support portion are coplanar with the plane; and wherein the securing portion has a dimension that is larger than a dimension of the strap holding portion.

4. The bracket of claim 3, wherein:

the first retention portion has a terminal end that is oriented in a direction substantially opposite to a direction of a terminal end of the second retention portion.

5. The bracket of claim 3, wherein:

the first retention portion has a terminal end that is oriented in a direction analogous to a direction of a terminal end of the second retention portion.

6. The bracket of claim 1, further comprising:

a first bracket support portion connected to the securing portion and the first retention portion; and a second bracket support portion connected to the securing portion and the second retention portion;

wherein the first bracket support portion, the second bracket support portion, and the securing portion have a pentagonal shape;

wherein the first bracket support portion and the second bracket support portion are coplanar with the plane; and wherein the securing portion has a dimension that is larger than a dimension of the strap holding portion.

7. The bracket of claim 1, further comprising:

a first bracket support portion connected to the securing portion and the first retention portion; and a second bracket support portion connected to the securing portion and the second retention portion;

wherein the first bracket support portion and the second bracket support portion are substantially parallel;

wherein the first bracket support portion and the second bracket support portion are coplanar with the plane.

8. The bracket of claim 7, wherein the first retention portion further comprises:

a projection portion that is angled away from the plane, the projection portion allows the strap to slide into the strap holding portion.

9. The bracket of claim 1, wherein the device is one of:

an electronic device, a portable electronic device, a computer device, a display screen, an image projector, an IPAD, a notebook computer, an MP3 player, a personal data assistant, a cellular telephone, a camera, a smart phone, a non-electronic device, a marker board, a chalk board, a paper tablet.

10. The bracket of claim 1, wherein the bracket secures the device to one of:

a container, a stand, and a display.

* * * * *